United States Patent [19]

Dixen

[11] Patent Number: 4,642,984

[45] Date of Patent: Feb. 17, 1987

[54] CONTROL DEVICE FOR AT LEAST ONE HYDRAULICALLY OPERATED LOAD

[75] Inventor: Carl C. Dixen, Horuphav, Denmark

[73] Assignee: Danfoss A/S, Nordborg, Denmark

[21] Appl. No.: 853,393

[22] Filed: Apr. 18, 1986

[30] Foreign Application Priority Data

May 2, 1985 [DE] Fed. Rep. of Germany ..... 3515732

[51] Int. Cl.[4] ..... F15B 13/06

[52] U.S. Cl. ..... 60/427; 60/452; 137/270; 137/596.13

[58] Field of Search ..... 60/427, 452; 137/270, 137/596.13

[56] References Cited

U.S. PATENT DOCUMENTS

| | | | |
|---|---|---|---|
| 2,892,312 | 6/1959 | Allen et al. | 60/427 |
| 3,444,689 | 5/1969 | Budzich | 60/427 |
| 3,470,694 | 10/1969 | Budzich | 60/427 |
| 3,754,400 | 8/1973 | Parquet | 60/452 X |
| 4,051,868 | 10/1977 | Andersen | 137/596.13 |

*Primary Examiner*—Gerald A. Michalsky
*Attorney, Agent, or Firm*—Wayne B. Easton

[57] ABSTRACT

The invention relates to a hydraulic system of the type in which a pump unit supplies pressurized fluid to a plurality of bidirectional servomotors. The system includes at least two modules each of which includes a bidirectional servomotor, a control valve and a compensating valve on the upstream side of the control valve. The pump unit includes a feedback loop having a throttle and a pump pressure regulator in series. Each of the modules has a sensing conduit connected to a common header which is operable to sense load pressure at the upstream side of the control valve for controlling the compensating valve in accordance with the load pressure. A pressure divider comparator valve is connected to the header and a point in the feedback loop between the throttle and the pump pressure regulator. The comparator valve is operable to compare the pressure at such point with the pressure in the header and to bleed pressurized fluid from that point to the tank to equalize the pressures.

4 Claims, 4 Drawing Figures

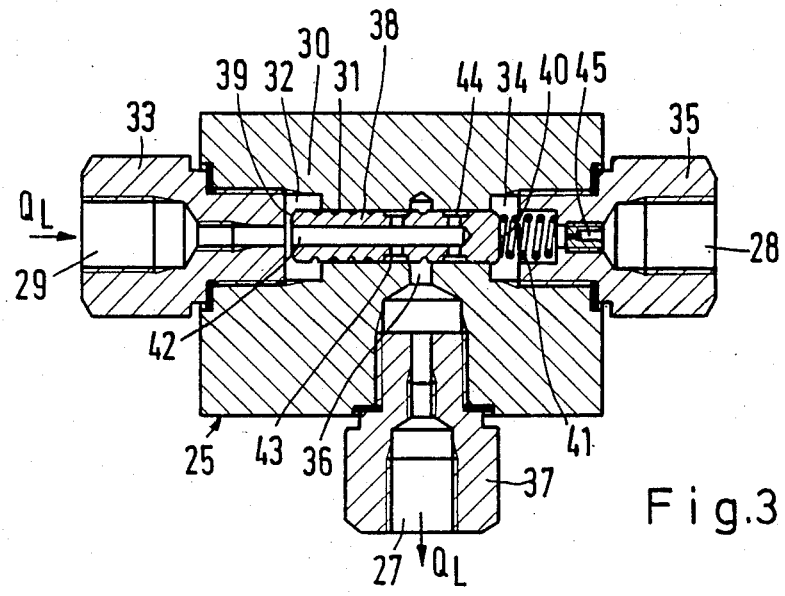
Fig.3
Fig.4
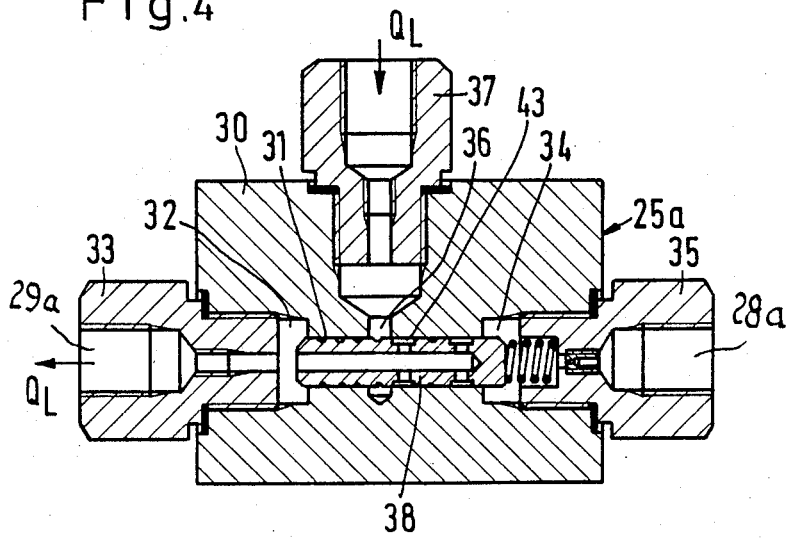

CONTROL DEVICE FOR AT LEAST ONE HYDRAULICALLY OPERATED LOAD

The invention relates to a control device for at least one hydraulically operated load fed by a pump by way of a control valve, wherein a compensating valve in series with each control valve is connected to a first section and a pump pressure regulator to a second section of a sensing conduit which is connected to a point at upstream load pressure and, by way of a throttle, to a point at different pressure, and wherein, when there are at least two loads, the second sensing conduit is common to all loads and connected by way of a change-over apparatus to that first sensing conduit section which is at the highest pressure.

In known control devices of this kind (DE-AS No. 25 14 624), the pump pressure regulator, which may, for example, comprise a discharge valve or a compression control, has the task of keeping the pump power as low as possible in that the pump pressure is made to follow the highest load pressure at a somewhat higher level. The compensating valve associated with each control valve is to keep the pressure drop across the control valve constant so that the control valve acts as a proportional valve in which each valve position corresponds to a particular flow quantity irrespective of the particular pump pressure. In operation, however, it has been found that this proportionality is practically impossible to maintain.

The invention is based on the problem of providing a control device of the aforementioned kind in which the proportionality of the control valves is maintained to a higher degree than hitherto.

This problem is solved according to the invention in that a separating comparator in the second sensing conduit section so controls a pressure dividing valve lying between the pump conduit and vessel in series with the throttle, that the pressure on both sides of the separating comparator is substantially equal and that the pump pressure regulator is connected between the throttle and pressure dividing valve.

This control device construction is based on the consideration that the sensing conduit defined by the housing bore and the like does not exhibit negligible throttling resistances. Consequently, by reason of the leakage flow occuring because of the different pressure level at both ends of the sensing conduit and in any case required for replenishing the pump pressure regulator, disruptive pressure drops occur at least in the first sensing conduit section.

The compensating valve will then no longer keep the pressure difference at the inlet and outlet of the control valve constant. Instead, there will be a pressure difference which departs therefrom by the pressure drop in the first sensing conduit section. In the control device according to the invention, this disruptive pressure drop influencing the proportionality of the control valve will no longer occur. The separating comparator avoids the leakage flow in the first sensing conduit section. Nor is there a danger, in the case of slowly opening a control valve in which an operating conduit is first connected to the sensing conduit and only then to the pump, of pressure fluid flowing from a load by way of the sensing conduit to result in unintentional adjustment in the wrong direction. Conversely, leakage flow is maintained in the region of the pump pressure regulator because it can take place by way of the series circuit of throttle and pressure distributing valve. For example, the conduit between the pump and the pump pressure regulator is rinsed out so that the oil is rapidly heated and any air occlusions are eliminated, which increases the regulating accuracy particularly upon starting. Despite the leakage losses, greater play in the regulator is acceptable. A pressure drop achieved by means of the leakage flow can be utilised to create an adjustable standby pressure for the pump. A single separating comparator will be sufficient even in the presence of a plurality of loads.

In a preferred construction, the separating comparator comprises a slide of which the end faces are disposed in pressure chambers which are each connected to one sensing conduit connector of the separating comparator and comprises control orifices which, together with control orifices in a housing bore, define the pressure dividing valve. In this case the slide serves as a separating element, comparator and movable valve element.

It is favourable for the control orifice of the slide to be disposed substantially in its centre and the control orifice of the housing bore to be disposed eccentrically and for the housing bore to open at both sides into a chamber for receiving a connecting nipple. A separating comparator of such a construction can be employed when the other pressure is defined by the pump pressure, and also when the other pressure is defined by the tank pressure. It is only necessary to turn the housing through 180°. By reason of the eccentric control orifice of the housing bore, the control orifice of the slide is selectively disposed on the one or other side of the control orifice of the housing bore and therefore changes its valve function.

Advantageously, the control orifice of the slide is connected to a blind hole in the slide and the control orifice of the housing bore is connected to a housing connector. This simplifies the construction.

A groove that is likewise connected to the blind hole may be provided at the slide between the control orifice and the pressure chamber on the pressure side of the load. Since the groove is substantially at the same pressure as the pressure in the pressure chamber on the load side, any leakage through the separating comparator is prevented.

Further, the slide may be loaded by a weak spring at the end on the side of the load pressure. This spring does not participate in the regulation but will ensure a clear starting position for the slide if the sensing pressure is absent.

Further, it is of advantage to provide a restrictor at the inlet of the pressure chamber on the side of the load pressure. This enables damping of any oscillation in the system.

Preferred examples of the invention will now be described in more detail with reference to the drawing, wherein:

FIG. 3 is a cross-section through a separating comparator employed in FIG. 1; and FIG. 4 is a cross-section through a separating comparator employed in FIG. 2.

Figures 1, 2:
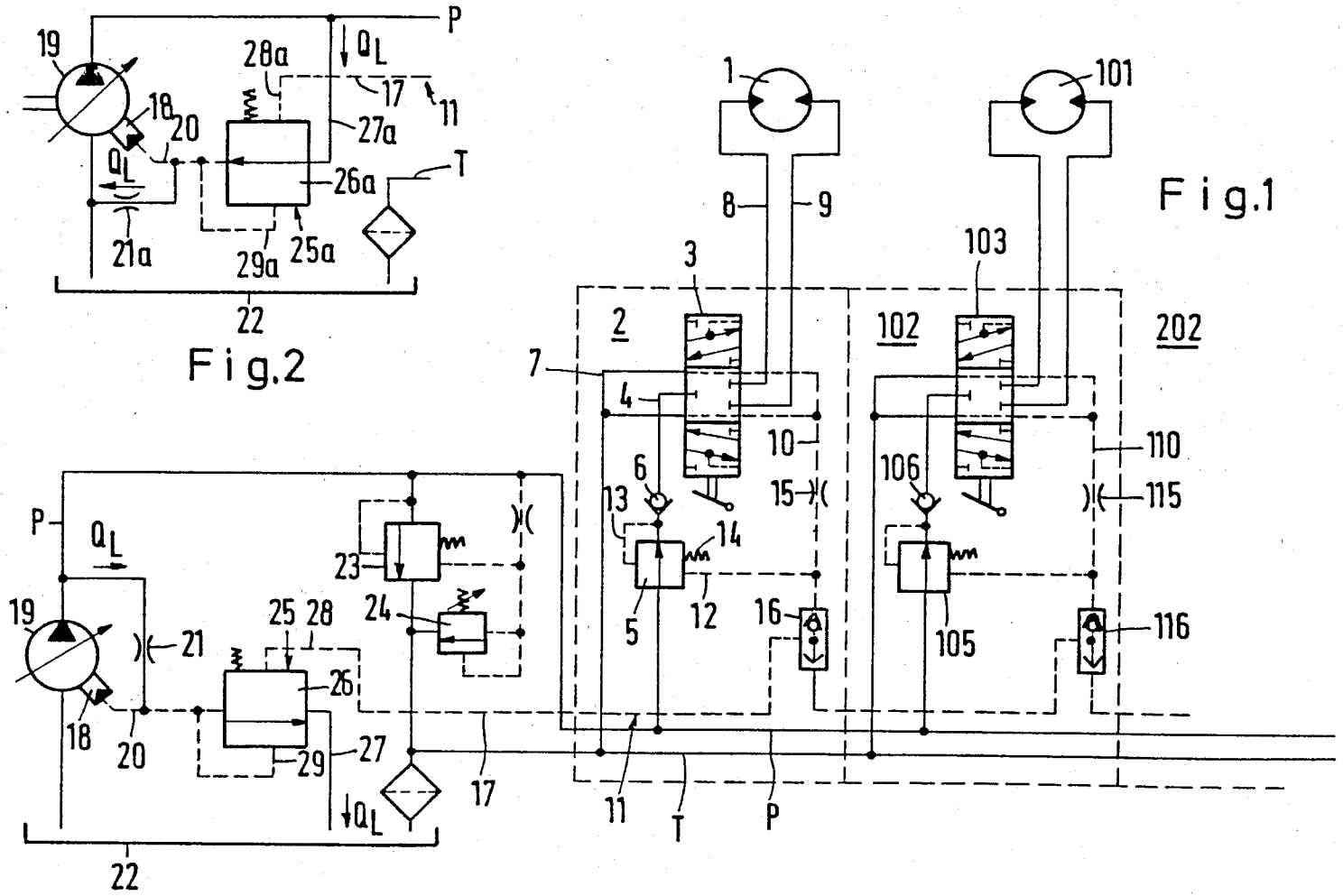
FIG. 1 is a simplified circuit diagram of a control device according to the invention.
FIG. 2 is a modification of part of the FIG. 1 control circuit.

The control circuit of FIG. 1 serves to operate two loads 1 and 101 which are in the form of reversable motors and which are each operable by one control unit 2, 102. Further control units 202 et seq. with corresponding loads may follow. The loads may also be hydraulic cylinders or the like.

The control unit 2 comprises a control valve 3 of which the inlet 4 on the pressure side is connected by way of a compensating valve 5 and a check valve 6 to a throughgoing pump conduit P. The downstream connector 7 is connected to a throughgoing tank conduit T. In the illustrated neutral position of the control valve 3, the two operating conduits 8 and 9 leading to the load are separated from the pump conduit P as well as from the tank conduit T. Upon transition into the two operating positions, the throttle apertures of the control valve 3 open progressively in such a way that the one operating conduit is connected to the pump conduit P and the other operating conduit to the tank conduit T.

A first section 10 of a sensing conduit 11 is so connected to the control valve 3 that it is connected to the tank conduit T in the neutral position whereas the pressure on the load side is scanned in the operating positions. The first sensing conduit section 10 is also connected to one control input 12 of the compensating valve 5 and the other control input 13 measures the pressure in front of the control valve 3. A spring 14 ensures that the compensating valve 5 is set so that a pre-determined pressure drop occurs at the control valve 3. However, this occurs only on the condition that no pressure drop occurs by reason of any leakage flow or the like at the diagrammatically indicated throttle resistance 15. This throttle resistance is inevitable for the sensing conduit by reason of the limited flow sections.

By way of a switching apparatus 16 which is here in the form of a shuttle valve, the first sensing conduit section 10 is connected to a common second sensing conduit section 17. This serves to influence a pump pressure regulator 18 associated with the pump 19. The pump pressure regulator is adapted to change the compression of the pump 19. The control input 20 of the pump pressure regulator is connected by way of a throttle 21 to the pump conduit P.

The pump 19 withdraws the liquid from a tank 22 and conveys it by way of the pump conduit P to the individual control units 2 et seq.. An over-pressure valve 24 connects the pump conduit P to the tank conduit T. The effect of the over-pressure valve can be intensified by a relief valve 23.

A separating comparator 25 in the second section 17 of the sensing conduit 11 comprises a valve 26 between the inlet 20 of the pump pressure regulator 18 and a conduit 27 leading to the vessel 22. The one sensing conduit connector 28 of the separating comparator 25 communicates with the second sensing conduit section 17 on the side of the load pressure whilst the other sensing conduit connector 29 communicates with the section of this conduit on the throttle side. The separating comparator which will be described in more detail in relation to FIGS. 3 and 4 ensures that the pressure in the section of the sensing conduit on the side of the load pressure is maintained but that no leakage fluid will reach the sensing conduit 11 by way of the throttle 21. Accordingly, there will be no pressure drop at the throttling resistance 15 and consequently no falsification of the work of the compensating valve 5.

The same applies to control unit 102 in which equivalent parts are provided with reference numerals increased by 100, and to all other control units.

In the embodiment of FIG. 2, identical components have the same reference numeral as in FIG. 1. The difference is that the second section 17 of the sensing conduit 11 is connected by way of a throttle **21*a* to the vessel 22. Further, a separating comparator 25*a* is provided with a valve 26*a* which opens on an increase in sensing pressure whereas the valve 26 in FIG. 1** closes with an increase in sensing pressure.

FIG. 3 shows the separating comparator 25 of FIG. 1. In a housing 30 there is a bore 31 which opens on one side into a chamber 32 for receiving a connecting nipple 33 and on the other side into a chamber 34 for receiving connecting nipple 35. The connecting nipple 33 corresponds to the sensing conduit connector 29 and the connecting nipple 35 to the sensing conduit connector 28 of the separating comparator 25. In the middle of the bore there is a control orifice 36 which communicates with a housing connector 37. In the housing bore 31 there is a slide 38 of which the end face 39 projects into the chamber 32 and the end face 40 into the chamber 34 and which is loaded by a weak spring 41 supported against the connecting nipple 35. A blind hole 42 in the slide 38 opens into the chamber 32 and communicates by way of radial bores with a control orifice 43 in the form of a groove as well as with an annular groove 44 in the vicinity of the end face 40. A restrictor 45 is inserted in the connecting nipple 35 to damp oscillations in the system.

In operation, the slide 38 assumes force equilibrium positions in which the pressure in the chamber 32 follows the sensing pressure in the chamber 34. The force of the spring 41 is so low that it can be substantially disregarded. Consequently, the sensing pressure in the part of the sensing conduit 11 on the side of the load pressure is maintained and is made to follow in the remaining portion where a supply of leakage oil is required for the pump pressure regulator. However, the amount $Q_L$ of leakage oil supplied by way of the throttle 21 flows off to the tank 22 by way of the valve 26 represented by the control orifices 36 and 43. The pressure in the annular groove 44 is therefore substantially the same as that in the chamber 34. Accordingly, leakage losses are avoided.

The FIG. 4 embodiment uses the same parts as in FIG. 3. However, the housing 30 with housing connector 37 is turned through 180° in the plane of the drawing whilst the connecting nipples 33 and 35 as well as the slide 38 maintain their position. Whereas the control orifice 43 of the slide is disposed substantially at its centre, the control orifice 36 of the housing bore 31 is disposed eccentrically of the housing bore. For this reason, the control orifice 43 disposed between the chamber 32 and the control orifice 36 in the case of FIG. 3 is in FIG. 4 arranged between the chamber 34 and this control orifice 36. The function of the valve 26 has therefore changed to that of the valve **26*a*. In this case, the amount $Q_L$ of leakage oil flows from the pump conduit P to the connector 20 of the pump pressure regulator 18 and then on by way of the throttle 21*a* to the tank 22**.

Instead of the illustrated pump pressure regulator 18, there may also be a pump of constant output in parallel with a diverting valve controlled by the sensing pressure.

I claim:

1. A hydraulic system comprising pump and tank means and at least two modules each of which includes a bidirectional servomotor and a control valve having operating positions for supplying pressurized fluid from said pump means to said tank means and for exhausting fluid from said servomotor to said tank means, each of said modules having compensating valve means between said control valve thereof and said pump means, said pump means including a feedback loop having a throttle and a pump pressure regulator in series, a sensing conduit header, each of said modules having sensing conduit means connected to said header and being operable to sense load pressure at the inlet side of said control valve thereof for controlling said compensating valve means in accordance with said load pressure, and a pressure divider comparator valve connected to said header and to a point in said feedback loop between said throttle and said pump pressure regulator, said comparator valve being operable to compare the pressure at said point with the pressure in said header and to bleed pressurized fluid from said point to said tank means to equalize said pressures.

2. A hydraulic system according to claim 1 wherein said comparator valve includes a housing with a bore and a slide valve having opposite end faces slidably mounted in said bore, said housing forming pressure chambers on opposite sides of said slide valve in which said end faces are disposed, said pressure chambers having fluid communication with said header and said point in said feedback loop, and cooperable control orifices in said slide valve and said housing bore for bleeding pressurized fluid from one of said pressure chambers to said tank means.

3. A hydraulic system according to claim 2 wherein said control orifice of said slide valve is disposed substantially at its center axially thereof and said control orifice of said housing bore is disposed away from its center axially thereof.

4. A hydraulic system according to claim 2 wherein said pressure chamber associated with said header has oscillation damping means associated therewith (a diaphragm through which pressure but not fluid is transmitted thereto from said header).

* * * * *